US006737910B2

(12) United States Patent
Kitagawa et al.

(10) Patent No.: US 6,737,910 B2
(45) Date of Patent: May 18, 2004

(54) SEMICONDUCTOR INTEGRATED CIRCUIT WITH CONSTANT INTERNAL POWER SUPPLY VOLTAGE

(75) Inventors: Yasuhiro Kitagawa, Kawasaki (JP); Hiroshi Fujii, Kawasaki (JP); Shoji Isawa, Kawasaki (JP); Yukihiro Yaguchi, Chuo (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/454,511

(22) Filed: Jun. 5, 2003

(65) Prior Publication Data

US 2003/0231052 A1 Dec. 18, 2003

(30) Foreign Application Priority Data

Jun. 13, 2002 (JP) ..... 2002-172770

(51) Int. Cl.[7] ..... G05F 1/10
(52) U.S. Cl. ..... 327/541; 327/566
(58) Field of Search ..... 327/530, 534, 327/535, 538, 540, 541, 543, 545, 546, 564, 565, 566

(56) References Cited

U.S. PATENT DOCUMENTS 6,107,869 A 8/2000 Horiguchi et al.
6,667,652 B2 * 12/2003 Hosoki ..... 327/538

FOREIGN PATENT DOCUMENTS

JP 11-017135 1/1999

* cited by examiner

*Primary Examiner*—Jeffrey Zweizig
(74) *Attorney, Agent, or Firm*—Arent Fox PLLC

(57) ABSTRACT

A semiconductor integrated circuit includes a first power supply line which supplies an external power supply voltage provided from an exterior of the circuit, a second power supply line which supply an internal power supply voltage to an interior circuit, a plurality of NMOS transistors which are situated at different locations, and have drain nodes thereof coupled to the first power supply line and source nodes thereof coupled to the second power supply line, and a regulator circuit which supplies a reference voltage to gate nodes of the plurality of NMOS transistors.

10 Claims, 5 Drawing Sheets

22

SEMICONDUCTOR INTEGRATED CIRCUIT WITH CONSTANT INTERNAL POWER SUPPLY VOLTAGE

CROSS-REFERENCE TO RELATED APPLICATIONS

The present application is based upon and claims the benefit of priority from prior Japanese Patent Application No. 2002-172770 filed on Jun. 13, 2002, with the Japanese Patent Office, the entire contents of which are incorporated herein by reference.

BACKGROUND OF THE INVENTION

1. Field of the Invention

The present invention generally relates to semiconductor integrated circuits, and particularly relates to a semiconductor integrated circuit which is provided with a built-in DC—DC regulator.

2. Description of the Related Art

Semiconductor integrated circuits in recent years tend to use a reduced power supply voltage to drive internal circuitry due to an increasing degree of finer fabrication and higher circuit density. To this end, a DC—DC regulator is provided inside devices for the purpose of reducing an externally provided power supply voltage to generate an internal power supply voltage. This internal power supply voltage is supplied to each circuit part inside the integrated circuit.

FIG. 1 is an illustrative drawing showing a structure relating to the supply of a power-supply voltage in a related-art semiconductor integrated circuit.

In the semiconductor integrated circuit of FIG. 1, an external power supply voltage VCC applied to a power-supply input terminal 11 is led to a DC—DC regulator 12. The DC—DC regulator 12 generates an internal power supply voltage by reducing the external power supply voltage VCC, and transmits the internal power supply voltage to power supply lines 13. The power supply lines 13 are laid out to reach each corner of the semiconductor integrated circuit in order to supply the internal power supply voltage to each interior circuit 15. Further, the power supply lines 13 are connected to a terminal 14 to which a condenser is to be coupled for the purpose of suppressing oscillation. A ground voltage VSS is supplied to ground terminals 16 from the exterior, and is supplied to each circuit unit inside the semiconductor integrated circuit.

FIG. 2 is an illustrative drawing for explaining an operation of the mechanism as shown in FIG. 1 that supplies a power supply voltage.

In FIG. 2, an external power supply voltage is denoted as V1, and an internal power supply voltage is designated as V2. The DC—DC regulator 12 receives the external power supply voltage V1, and reduces it to generate the internal power supply voltage V2. The internal power supply voltage V2 is transmitted to the power supply line 13. The power supply line 13 extends a long distance, so that a potential drop as shown in the upper half of FIG. 2 is observed. In the upper half of FIG. 2, the horizontal axis represents the extension of the line, and the vertical axis represents the power supply voltage.

A drop in the power supply voltage caused by line resistance inside semiconductor integrated circuits has been recognized as a cause of circuit malfunction. In order to obviate this problem, software may be used to estimate electric current running through the power supply lines, and the power supply lines may be widened through optimization based on the software analysis. This method, however, offers only a limited effect of voltage-drop reduction. As a different measure, regulators may be provided for respective circuit modules that consume power supply, thereby stabilizing a power supply voltage at each of the circuit modules. Since a power supply circuit occupies a relatively large area inside semiconductor integrated circuits, this method is not practical from an economic standpoint. It is conceivable to adopt a circuit design that provides a voltage margin by taking into account a power supply voltage drop. This is not desirable because such a design puts a limit on performance. Since a power supply voltage of recent semiconductor integrated circuits has been lowered significantly, a tolerable range of an internal power supply voltage is now quite narrow. As a result, it is becoming increasingly difficult to cope with this issue through simple design modification.

Accordingly, there is a need for a semiconductor integrated circuit which can prevent a drop in an internal power supply voltage generated by a DC—DC regulator without increasing chip size.

SUMMARY OF THE INVENTION

It is a general object of the present invention to provide a semiconductor integrated circuit that substantially obviates one or more problems caused by the limitations and disadvantages of the related art.

Features and advantages of the present invention will be presented in the description which follows, and in part will become apparent from the description and the accompanying drawings, or may be learned by practice of the invention according to the teachings provided in the description. Objects as well as other features and advantages of the present invention will be realized and attained by a semiconductor integrated circuit particularly pointed out in the specification in such full, clear, concise, and exact terms as to enable a person having ordinary skill in the art to practice the invention.

To achieve these and other advantages in accordance with the purpose of the invention, the invention provides a semiconductor integrated circuit, including a first power supply line which supplies an external power supply voltage provided from an exterior of the circuit, a second power supply line which supply an internal power supply voltage to an interior circuit, a plurality of NMOS transistors which are situated at different locations, and have drain nodes thereof coupled to the first power supply line and source nodes thereof coupled to the second power supply line, and a regulator circuit which supplies a reference voltage to gate nodes of the plurality of NMOS transistors.

In the semiconductor integrated circuit as described above, a voltage drop may be generated by line resistance along the first power supply line when it extends a long distance. Even if this is the case, the NMOS transistors receiving the reference voltage at their gate nodes generate the internal power supply voltage at their source nodes based on the external power supply voltage. The internal power supply voltage is thus lower than the reference voltage by the threshold voltage of the NMOS transistors. In this manner, the semiconductor integrated circuit of the present invention can maintain a constant internal power supply voltage on the second power supply line at any given locations.

The regulator serves only to apply the reference voltage to the gates of the NMOS transistors, and almost no current flows from the regulator the gate of each NMOS transistor. Even if lines extend a long distance from the regulator to the gates of the NMOS transistors, therefore, almost no voltage drop occurs along the lines.

In the construction as described above, the NMOS transistors can be regarded as transistors for supplying outputs that are generally provided at the outputting part of a DC—DC regulator. One way to look at the present invention is that the regulator has a plurality of power supply points, which are distributed at various locations, and that these power supply points distributed at various locations in the semiconductor integrated circuit can control voltages even when the external power supply voltage is lowered due to line resistance, thereby achieving a predetermined voltage level.

The number of the power supply points may be increased if necessary. It is thus possible to supply a stable power supply voltage to circuits that consume a large amount of electric currents, without resorting to the use of widened power supply lines. When the output transistors of a DC—DC regulator are distributed to various points along the power supply tree, distances between the power supply points and the locations of actual power consumption tend to be short. Further, the provision of more than one power supply point results in a reduced amount of an electric current per power supply point. It is thus possible to suppress a voltage drop to a minimum level when it is caused by line resistance of the power supply lines.

Other objects and further features of the present invention will be apparent from the following detailed description when read in conjunction with the accompanying drawings.

DESCRIPTION OF THE PREFERRED EMBODIMENTS

In the following, embodiments of the present invention will be described with reference to the accompanying drawings.

Figure 1:
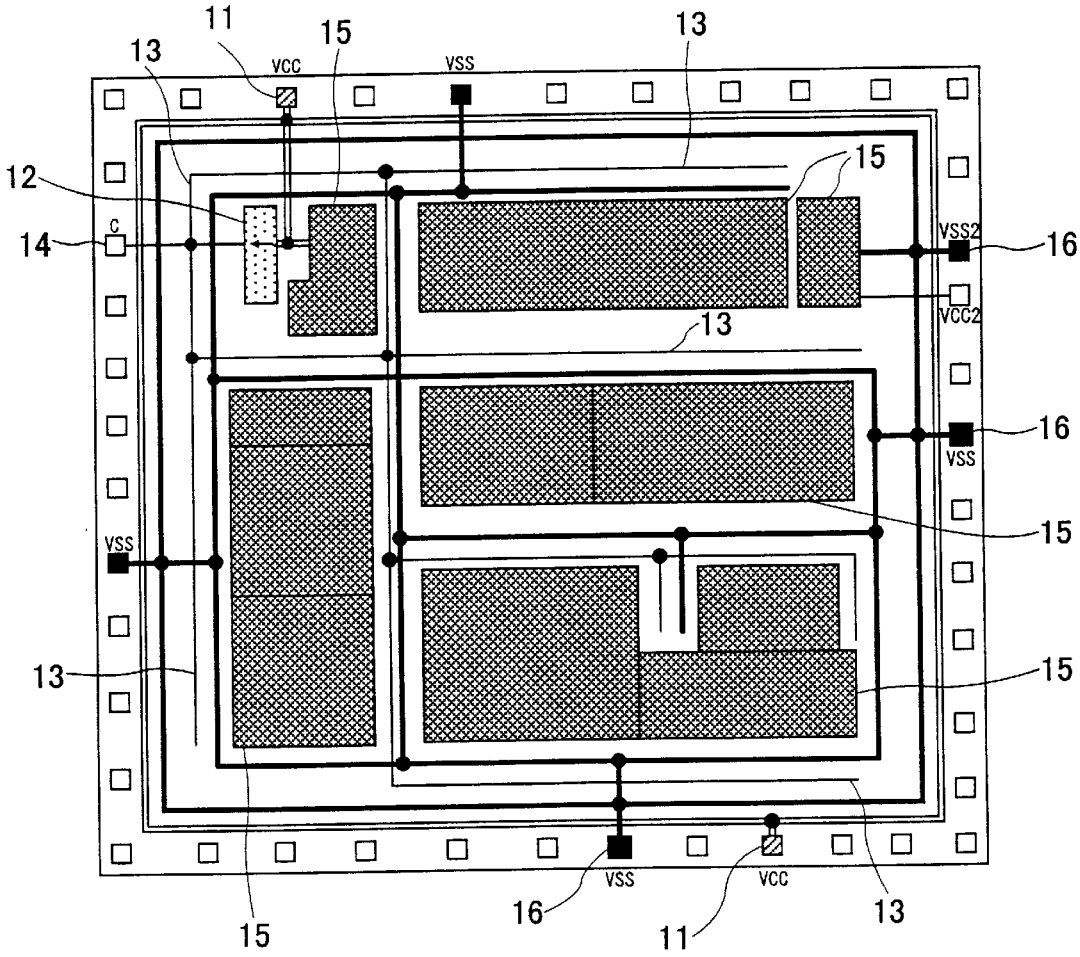
FIG. 1 is an illustrative drawing showing a structure relating to the supply of a power-supply voltage in a related-art semiconductor integrated circuit.
Figure 2:
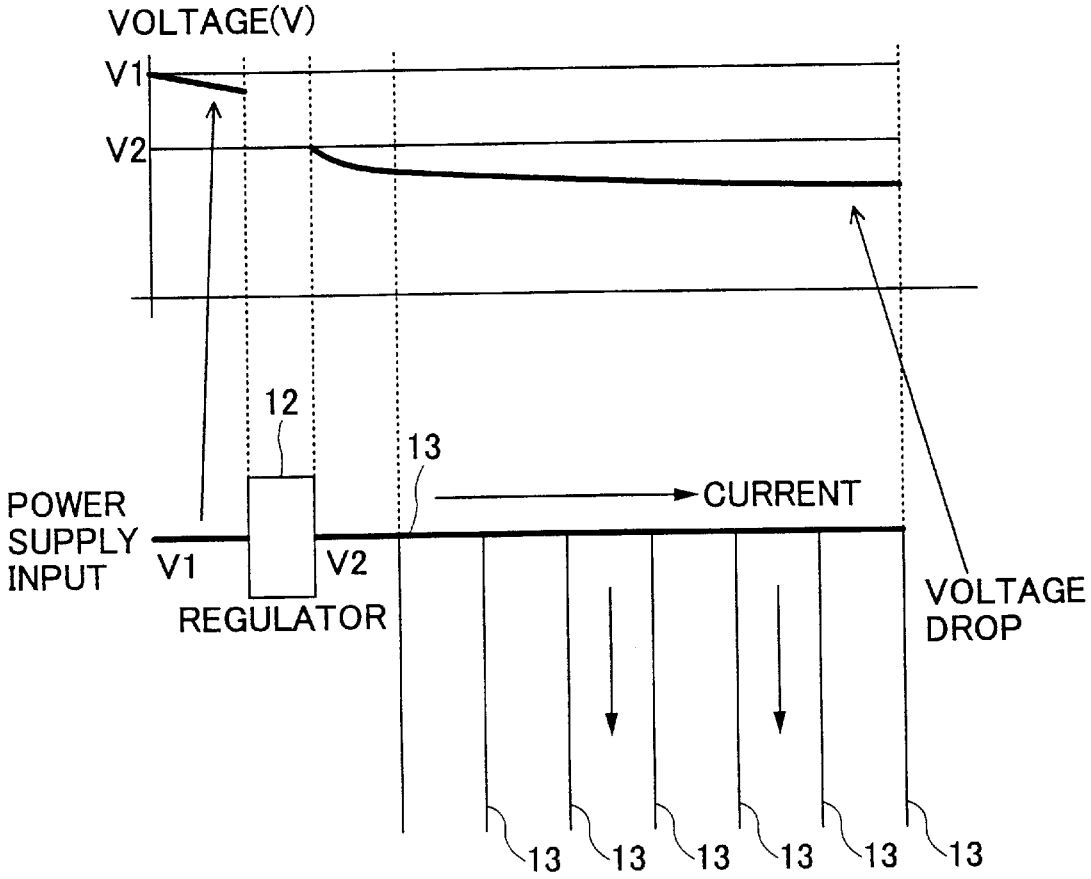
FIG. 2 is an illustrative drawing for explaining an operation of the mechanism of FIG. 1 that supplies a power supply voltage.
Figure 3:
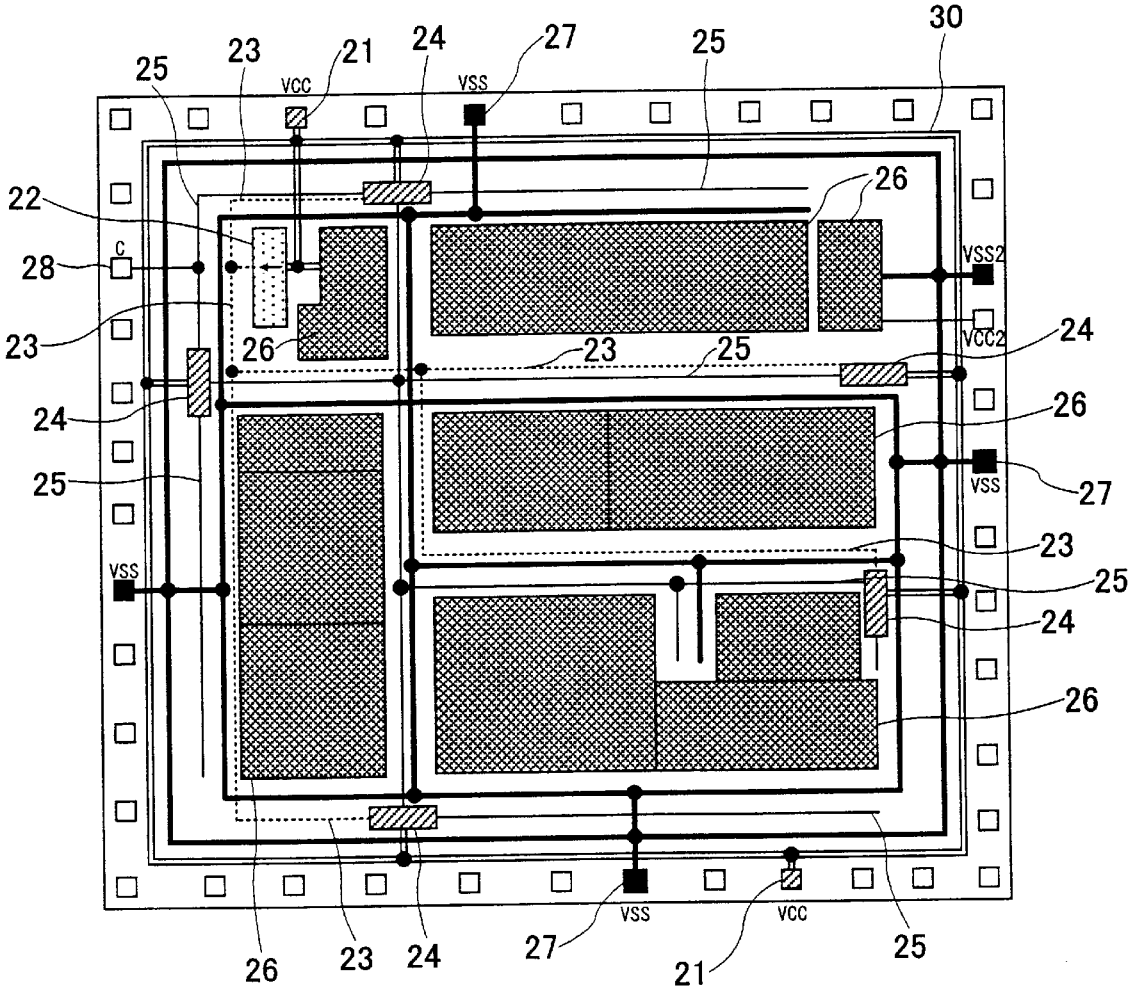
FIG. 3 is an illustrative drawing showing a structure by which a power supply voltage is supplied in an semiconductor integrated circuit according to the present invention.

FIG. 3 is an illustrative drawing showing a structure by which a power supply voltage is supplied in a semiconductor integrated circuit according to the present invention.

In the semiconductor integrated circuit of FIG. 3, an external power supply voltage VCC applied to a power-supply input terminal 21 is led to a DC—DC regulator 22. The DC—DC regulator 22 generates a reference voltage by reducing the external power supply voltage VCC, and transmits the reference voltage to reference voltage supply lines 23. The reference voltage supply lines 23 are connected to a plurality of voltage control transistor circuits 24 directly from the DC—DC regulator 22.

The external power supply voltage VCC applied to the power-supply input terminals 21 is also directly supplied to the voltage control transistor circuits 24 through power supply lines 30 that are provided at the periphery of the semiconductor integrated circuit. The voltage control transistor circuits 24 reduce the external power supply voltage VCC from the power supply lines 30 so as to generate a predetermined voltage according to a reference voltage supplied from the DC—DC regulator 22. The internal power supply voltage generated by the voltage control transistor circuits 24 are supplied to interior circuits 26 of the semiconductor integrated circuit through power supply lines 25. In FIG. 3, only trunk lines of the power supply lines 25 are illustrated. The power supply lines 25 may actually repeatedly branch so as to reach every one of the interior circuits 26.

The power supply lines 25 are connected to a terminal 28 to which a condenser is to be coupled for the purpose of suppressing oscillation. A ground voltage VSS is supplied to ground terminals 27 from the exterior, and is supplied to each circuit unit inside the semiconductor integrated circuit.

Figure 4:
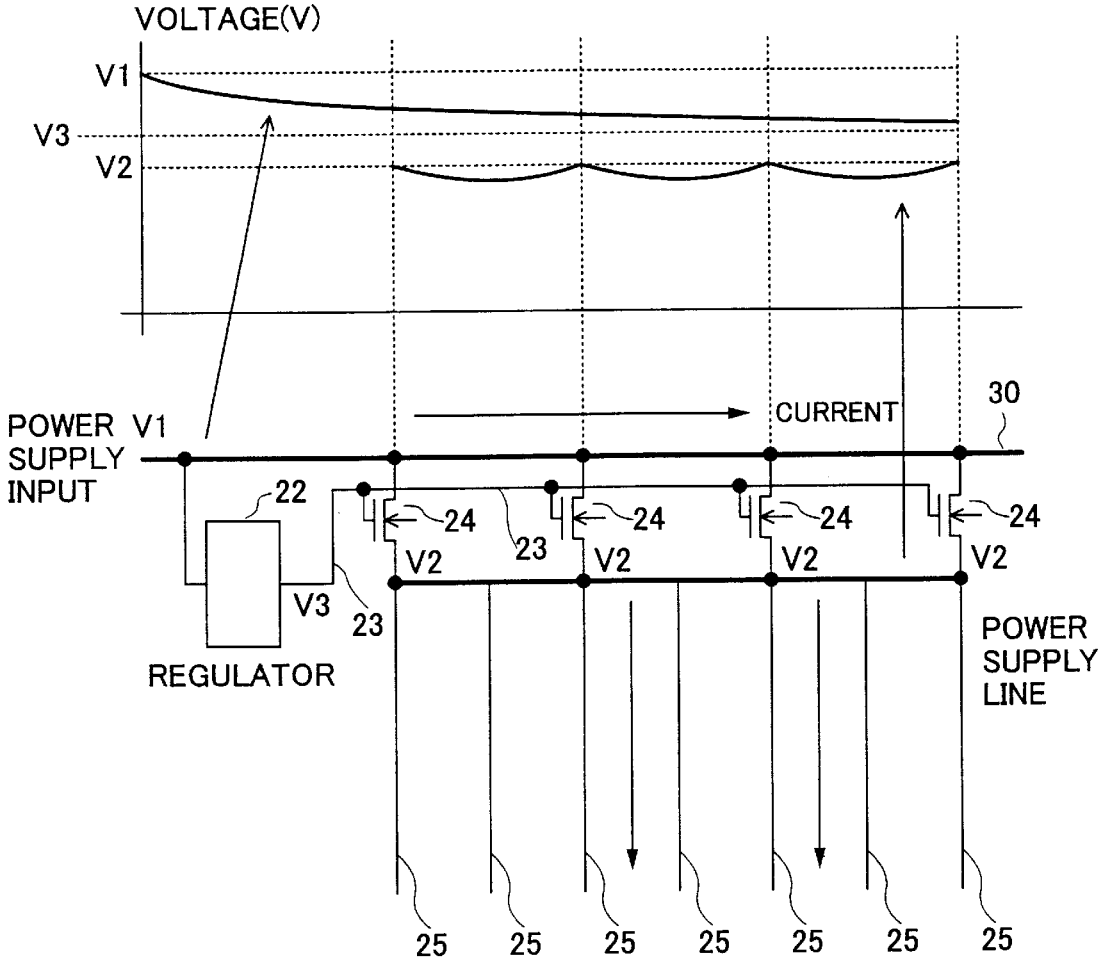
FIG. 4 is an illustrative drawing for explaining an operation of the mechanism of FIG. 3 that supplies a power supply voltage.

FIG. 4 is an illustrative drawing for explaining an operation of the mechanism as shown in FIG. 3 that supplies a power supply voltage.

In FIG. 4, the external power supply voltage is denoted as V1, and the internal power supply voltage generated by the voltage control transistor circuits 24 is designated as V2. Further, the reference voltage generated by the DC—DC regulator 22 is denoted as V3.

The DC—DC regulator 22 receives the external power supply voltage V1, and reduces it to generate the reference voltage V3. The reference voltage V3 is supplied through the reference voltage supply lines 23 to the voltage control transistor circuits 24 provided at various locations inside the semiconductor integrated circuit. Each of the voltage control transistor circuits 24 is comprised of an NMOS transistor as shown in FIG. 4, and receives at the gate the reference voltage V3 supplied from the DC—DC regulator 22. Source nodes of the NMOS transistors are coupled to the interior circuits 26 via the power supply lines 25, and drain nodes are connected to the power supply lines 30. In this construction, a drop of the voltage on the power supply lines 25 coupled to the interior circuits 26 will lead to an increase in the electric currents running through the NMOS transistors of the voltage control transistor circuits 24. In this manner, the NMOS transistors are situated at various locations along the power supply tree of the semiconductor integrated circuit, and are configured to form a source-follower.

The power supply lines 30 extend a long distance, so that a potential drop as shown in the upper half of FIG. 4 is observed. In the upper half of FIG. 4, the horizontal axis represents the extension of the lines, and the vertical axis represents the power supply voltage. In the present invention, the NMOS transistors 24 receiving the reference voltage V3 at their gate nodes generate the internal power supply voltage V2 at the source nodes based on the external power supply voltage V1. The internal power supply voltage V2 is thus lower than the reference voltage V3 by a threshold voltage of the NMOS transistor. In this manner, the power supply circuit of the present invention can maintain a constant internal power supply voltage on the power supply lines 25 at any given locations inside the semiconductor integrated circuit.

The DC—DC regulator 22 serves only to apply the reference voltage to the gates of the NMOS transistors 24 that are the voltage control transistor circuits. Almost no electric current, thus, flows along the reference voltage supply lines 23. Because of this, almost no voltage drop occurs along the reference voltage supply lines 23 even if the reference voltage supply lines 23 extend a long distance. Further, the DC—DC regulator 22 for generating the reference voltage needs to supply almost no load current, so that there is no need to use a bulky regulator having a strong drive capability as in the related-art.

In the configuration as described above, the NMOS transistors 24 serving as the voltage control transistor circuits 24 can be regarded as transistors for supplying outputs that are generally provided at the outputting part of a DC—DC regulator. One way to look at the present invention is that the regulator has a plurality of power supply points, which are distributed at various locations, and that these power supply points distributed at various locations in the semiconductor integrated circuit can control voltages even when the external power supply voltage is lowered due to line resistance, thereby achieving a predetermined voltage level. The number of the power supply points may be increased if necessary. It is thus possible to supply a stable power supply voltage to circuits that consume a large amount of electric currents, without resorting to the use of widened power supply lines.

When the output transistors of a DC—DC regulator are distributed to various points along the power supply tree, distances between the power supply points and the locations of actual power consumption tend to be short. Further, the provision of more than one power supply point results in a reduced amount of an electric current per power supply point. It is thus possible to suppress a voltage drop to a minimum level when it is caused by line resistance of the power supply lines.

The DC—DC regulator generally monitors its output voltage all the time, and uses feedback control to suppress output fluctuation. In the present invention, however, the DC—DC regulator serves only to supply a constant voltage to the gates of the NMOS transistors 24 that function as the power supply points. The DC—DC regulator of the present invention does not monitor a voltage at a location where the load is connected (i.e., the voltage observed at the interior circuits 26 that are connected to the power supply lines 25).

This circuit construction may give rise to a problem that the internal power supply voltage V2 may vary if the threshold voltage Vth of the transistors has product variation. This may be the case even if the reference voltage V3 is constant. In the following, a configuration that compensates for such product variation will be described.

Figure 5:
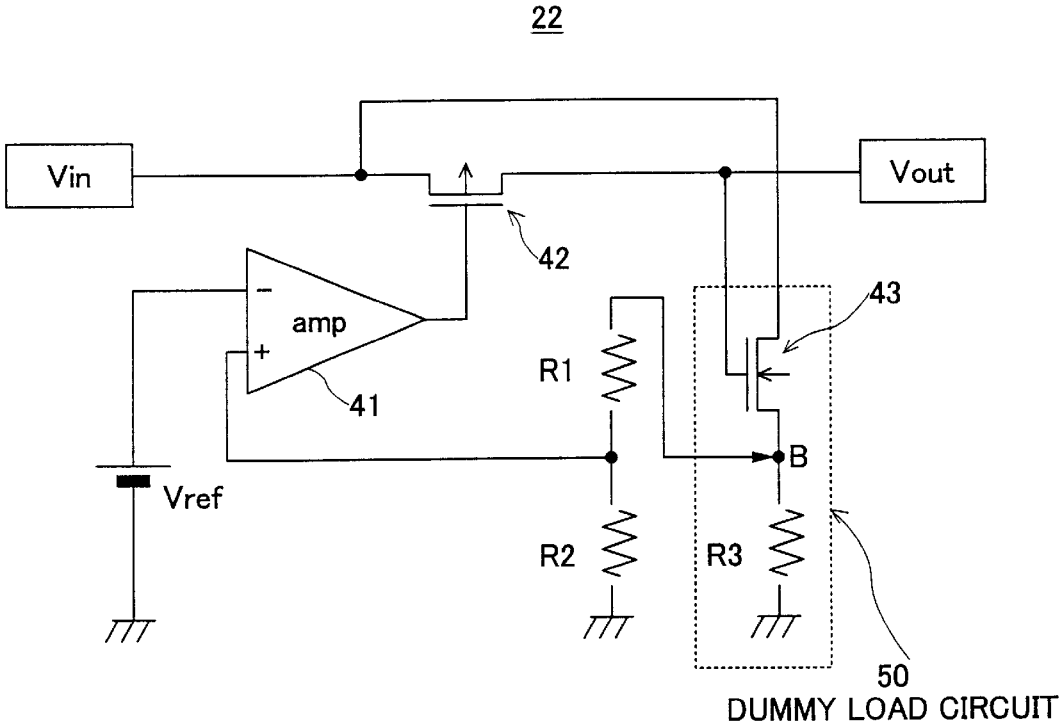
FIG. 5 is a circuit diagram showing an example of a DC—DC regulator according to the present invention.

FIG. 5 is a circuit diagram showing an example of the DC—DC regulator 22 according to the present invention.

The DC—DC regulator 22 of FIG. 5 includes a differential amplifier 41, NMOS transistors 42 and 43, and resistors R1 through R3. The NMOS transistor 43 and the resistor R3 together form a dummy load circuit 50. The NMOS transistor 43 of the dummy load circuit 50 is the same circuit element as the NMOS transistors of the voltage control transistor circuits 24. Further, the resistance R3 of the dummy load circuit 50 provides a load that is similar to the load on the NMOS transistors of the voltage control transistor circuits 24.

A node B situated between the NMOS transistor 43 and the resistor R3 in the dummy load circuit 50 is connected to a potential divider comprised of the resistors R1 and R2. A divided potential of the potential divider is supplied to one input of the differential amplifier 41. The other input of the differential amplifier 41 receives the reference voltage Vref. The output of the differential amplifier 41 is applied to the gate of the NMOS transistor 42, thereby controlling an output voltage Vout that is lowered relative to an input voltage Vin.

The dummy load circuit 50 as described above is provided to monitor the source-node voltage of the NMOS transistor 43 of the dummy load circuit 50 and to feedback the monitored voltage to the reference-voltage generating part. This achieves the generation of an output voltage that is constant regardless of product variation of the threshold voltage Vth.

In a conventional regulator circuit, the output voltage Vout of the NMOS transistor 42 would be detected to control the output voltage to a constant level. The DC—DC regulator 22 of the present invention, on the other hand, is provided with the dummy load circuit 50, and a voltage supplied to the load resistor of the dummy load circuit 50 is sensed so as to cancel the product variation of the transistor Vth. Product variation of the threshold voltages of NMOS transistors tends to be identical within a single semiconductor integrated circuit chip. Monitoring of the source-node voltage of the NMOS transistor 43 in the dummy load circuit 50 thus makes it possible to accurately control the source-node voltage of the NMOS transistors of the voltage control transistor circuits 24.

If the internal power supply voltage is about 3V, a voltage variation may fall within a 5%-error range under the presence of variation of the threshold voltage Vth. When a particularly high accuracy is not required, or when there is no need to generate a low internal power supply voltage, the dummy load circuit 50 of FIG. 5 may not need to be provided. In such a case, the output voltage Vout of the NMOS transistor 42 is monitored to supply a constant voltage.

Further, the present invention is not limited to these embodiments, but various variations and modifications may be made without departing from the scope of the present invention.

What is claimed is:

1. A semiconductor integrated circuit, comprising:

a first power supply line which supplies an external power supply voltage provided from an exterior of the circuit;

a second power supply line which supply an internal power supply voltage to an interior circuit;

a plurality of NMOS transistors which are situated at different locations, and have drain nodes thereof coupled to said first power supply line and source nodes thereof coupled to said second power supply line; and a regulator circuit which supplies a reference voltage to gate nodes of said plurality of NMOS transistors.

2. The semiconductor integrated circuit as claimed in claim 1, wherein said plurality of NMOS transistors are situated at the different locations that are dispersed throughout said semiconductor integrated circuit.

3. The semiconductor integrated circuit as claimed in claim 1, wherein said regulator circuit generates the reference voltage by reducing the external power supply voltage.

4. The semiconductor integrated circuit as claimed in claim 3, wherein said regulator circuit includes:

a reference voltage generating circuit which generates the reference voltage by reducing the external power supply voltage;

a dummy NMOS transistor which has a drain node thereof coupled to the external power supply voltage and a gate node thereof coupled to the reference voltage;

a dummy load that is coupled to a source node of said dummy NMOS transistor; and a control circuit which controls said reference voltage generating circuit through feedback control such that the source node of said dummy NMOS transistor is kept at a predetermined voltage.

5. A semiconductor integrated circuit, comprising:

a power supply terminal to which an external power supply voltage is applied from an exterior of the circuit;

a power supply line tree which supplies a power supply voltage from said power supply terminal to interior circuits;

a plurality of NMOS transistors which are inserted into said power supply line tree at different locations; and a regulator circuit which supplies a reference voltage to gate nodes of said plurality of NMOS transistors.

6. The semiconductor integrated circuit as claimed in claim 5, wherein said plurality of NMOS transistors are situated at the different locations that are dispersed throughout said semiconductor integrated circuit.

7. The semiconductor integrated circuit as claimed in claim 5, wherein said regulator circuit generates the reference voltage by reducing the external power supply voltage.

8. A semiconductor integrated circuit, comprising:

a power supply terminal to which an external power supply voltage is applied from an exterior of the circuit;

a first power supply line which is connected to said power supply terminal;

a regulator which generates an internal power supply voltage by reducing the external power supply voltage at different locations on said first power supply line; and a second power supply line which supplies the internal power supply voltage generated by said regulator to interior circuitry, wherein said regulator includes:

a plurality of output transistors which are inserted into said first power supply line at the different locations;

a reference voltage supply line which supplies a reference voltage to gate nodes of said plurality of output transistors; and a reference voltage generating circuit which generates the reference voltage.

9. The semiconductor integrated circuit as claimed in claim 8, wherein said plurality of output transistors are situated at the different locations that are dispersed throughout said semiconductor integrated circuit.

10. The semiconductor integrated circuit as claimed in claim 8, wherein said reference voltage generating circuit generates the reference voltage by reducing the external power supply voltage.

* * * * *